US007275839B2

(12) United States Patent
Coushaine et al.

(10) Patent No.: US 7,275,839 B2
(45) Date of Patent: Oct. 2, 2007

(54) THREE COLOR LED BULB

(75) Inventors: Charles M. Coushaine, Rindge, NH (US); Michael Tucker, Henniker, NH (US); Thomas Tessnow, Weare, NH (US)

(73) Assignee: Osram Sylvania, Inc., Danvers, MA (US)

( * ) Notice: Subject to any disclaimer, the term of this patent is extended or adjusted under 35 U.S.C. 154(b) by 263 days.

(21) Appl. No.: 11/098,812

(22) Filed: Apr. 5, 2005

(65) Prior Publication Data

US 2006/0220990 A1 Oct. 5, 2006

(51) Int. Cl.
*F21V 9/00* (2006.01)

(52) U.S. Cl. ..... 362/231; 362/39; 362/227; 362/496; 362/511; 362/543; 362/545; 362/800

(58) Field of Classification Search ..... 362/39, 362/227, 231, 496, 500, 543, 545, 800, 511, 362/555

See application file for complete search history.

(56) References Cited

U.S. PATENT DOCUMENTS

2003/0193802 A1* 10/2003 Luk ..... 362/249

* cited by examiner

*Primary Examiner*—Stephen K. Husar
*Assistant Examiner*—Meghan K. Dunwiddie
(74) *Attorney, Agent, or Firm*—William E. Meyer

(57) ABSTRACT

The multi-color light lamp has a base divided into a plurality of segments. The three segments are spaced at 120 degrees. More or less segments can be used. An LED is positioned in each segment, the LED in each segment emits a color distinct from the light emitted by the LEDs in the other segments. If the lamp is to be used for automotive purposes, the LED in a first segment emits red light as a taillight and a stop light, the LED in a second segment emits yellow light a turn signal lamp, and the LED in the third segment emits white light as a backup light. A light pipe is operatively associated with the LEDs in each segment for directing emitted light away from the base. The LEDs (preferably two per segment) are mounted upon a thermally efficient printed circuit board such as a flex-on aluminum board.

4 Claims, 4 Drawing Sheets

THREE COLOR LED BULB

TECHNICAL FIELD

This invention generally relates to lamps and more particularly to lamps employing light emitting diodes. Still more particularly it relates to multi-color light emitting lamps for automotive vehicles.

BACKGROUND ART

The rear of automotive vehicles typically is provided with separate lamps emitting three different colors of light; e.g., red for the tail light and stop light, amber or yellow for the turn signal and white for the backup light. The lamps are fitted into apertures in the automotive body and have replaceable bulbs. The bulbs for the lamps in the past have been filamented incandescent bulbs. Recently, some of the incandescent bulbs, particularly the center high mount stoplight, have been replaced with red emitting light emitting diodes (LED or LEDs). These solid-state light sources are efficient and have long life; however, they tend to generate a considerable amount of heat under continuous operation, such as would be encountered in a tail light as opposed to the intermittent operation of a stoplight. To dissipate the generated heat it is necessary to provide a viable heat sink. It would be an advance in the art if a single lamp could be provided for all three light functions. It would be a further advance in the art if the vehicle itself could provide the heat sinking function.

DISCLOSURE OF INVENTION

It is, therefore, an object of the invention to obviate the disadvantages of the prior art.

It is another object of the invention to enhance automotive lighting.

It is yet another object of the invention to provide a lamp that utilizes the vehicle body as its primary heat sink.

These objects are accomplished, in one aspect of the invention, by a multi-color light lamp comprising: a base divided into a plurality of segments; at least one LED operatively positioned in each segment, the at least one LED in each segment emitting light in a color distinct from the light emitted by the at least one LED in the other segments; and a light pipe operatively associated with the at least one LED in each segment for directing emitted light away from said base.

In a preferred embodiment of the invention, the base includes a central mounting aperture containing a fastener that is directly affixed to a vehicle body, thereby utilizing the vehicle body as the heat sink.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
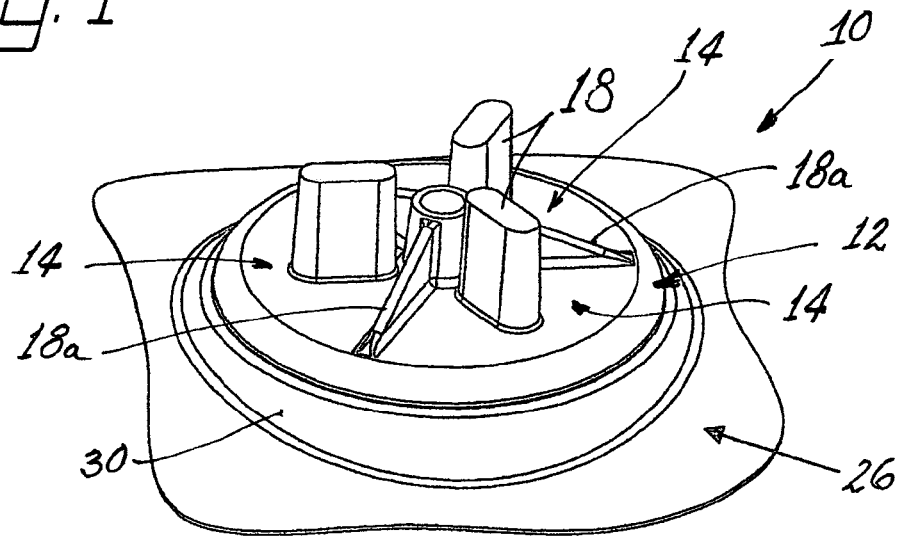
FIG. 1 is a perspective view of an embodiment of a lamp of the invention without a cover.
Figure 2:
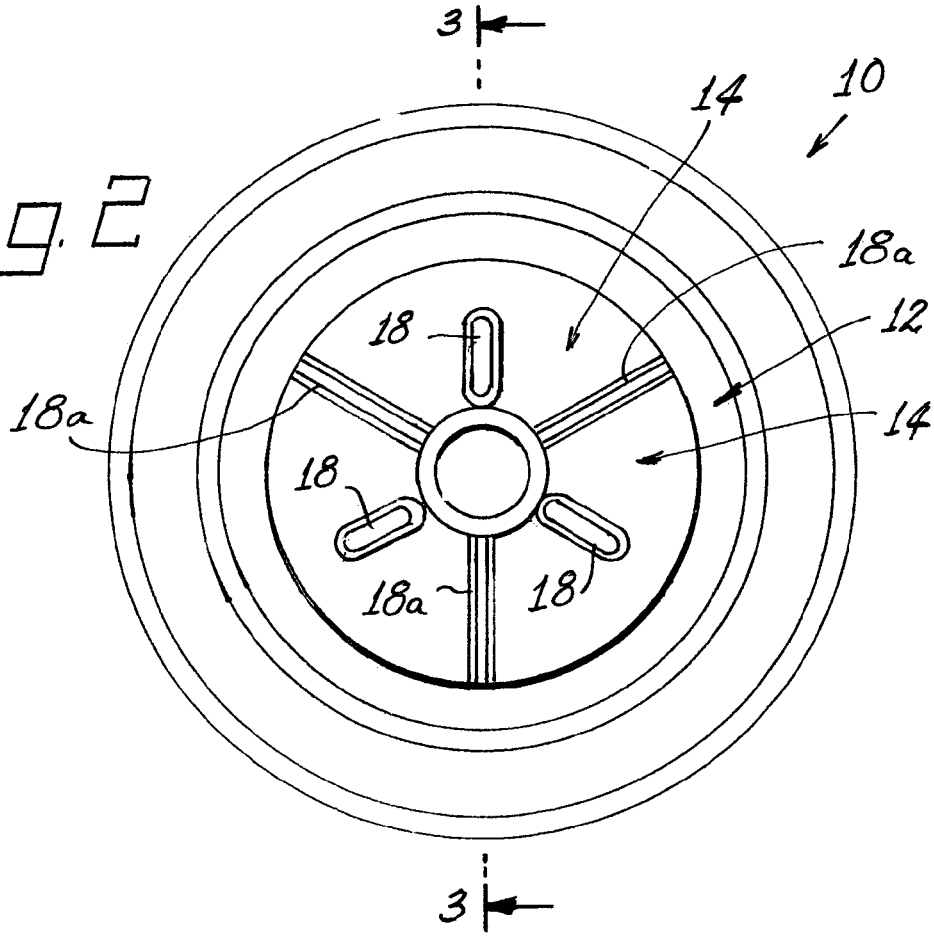
FIG. 2 is a plan view of the lamp of FIG. 1.
Figure 3:
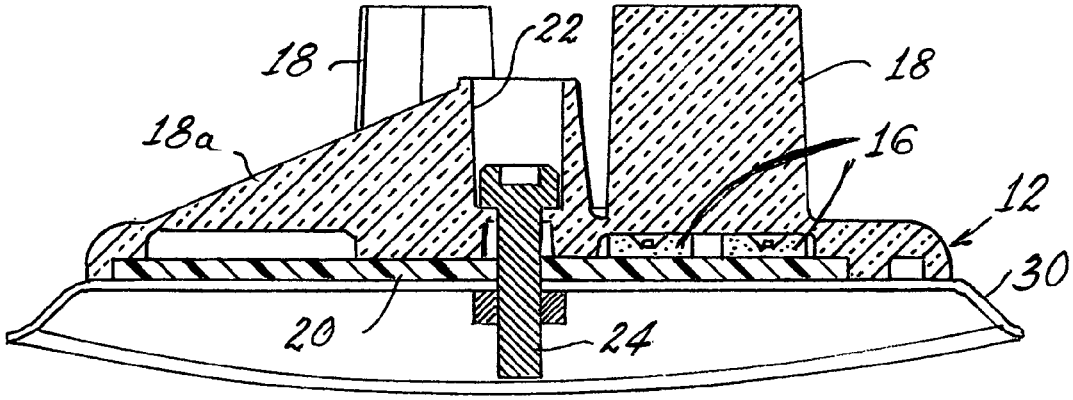
FIG. 3 is a sectional view taken along the line 3-3 of FIG. 2.
Figure 4:
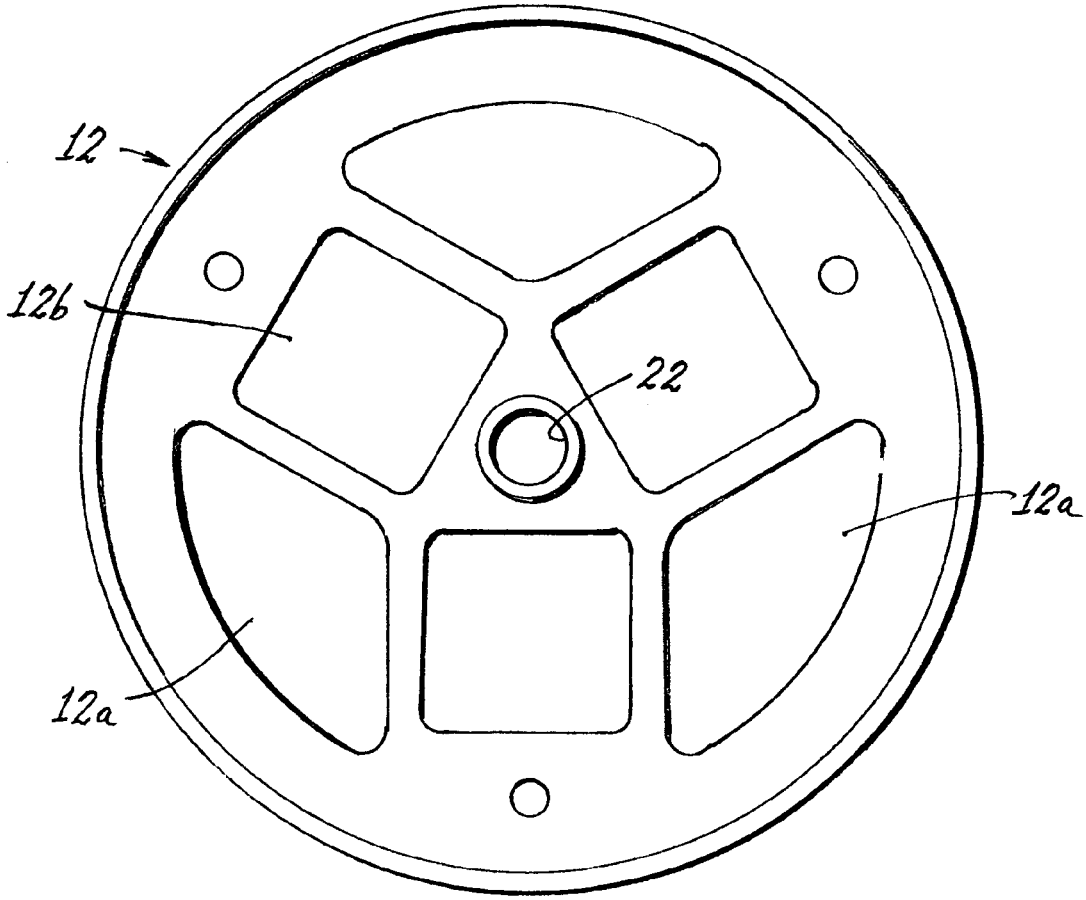
FIG. 4 is a plan view of the under side of an optic.
Figure 5:
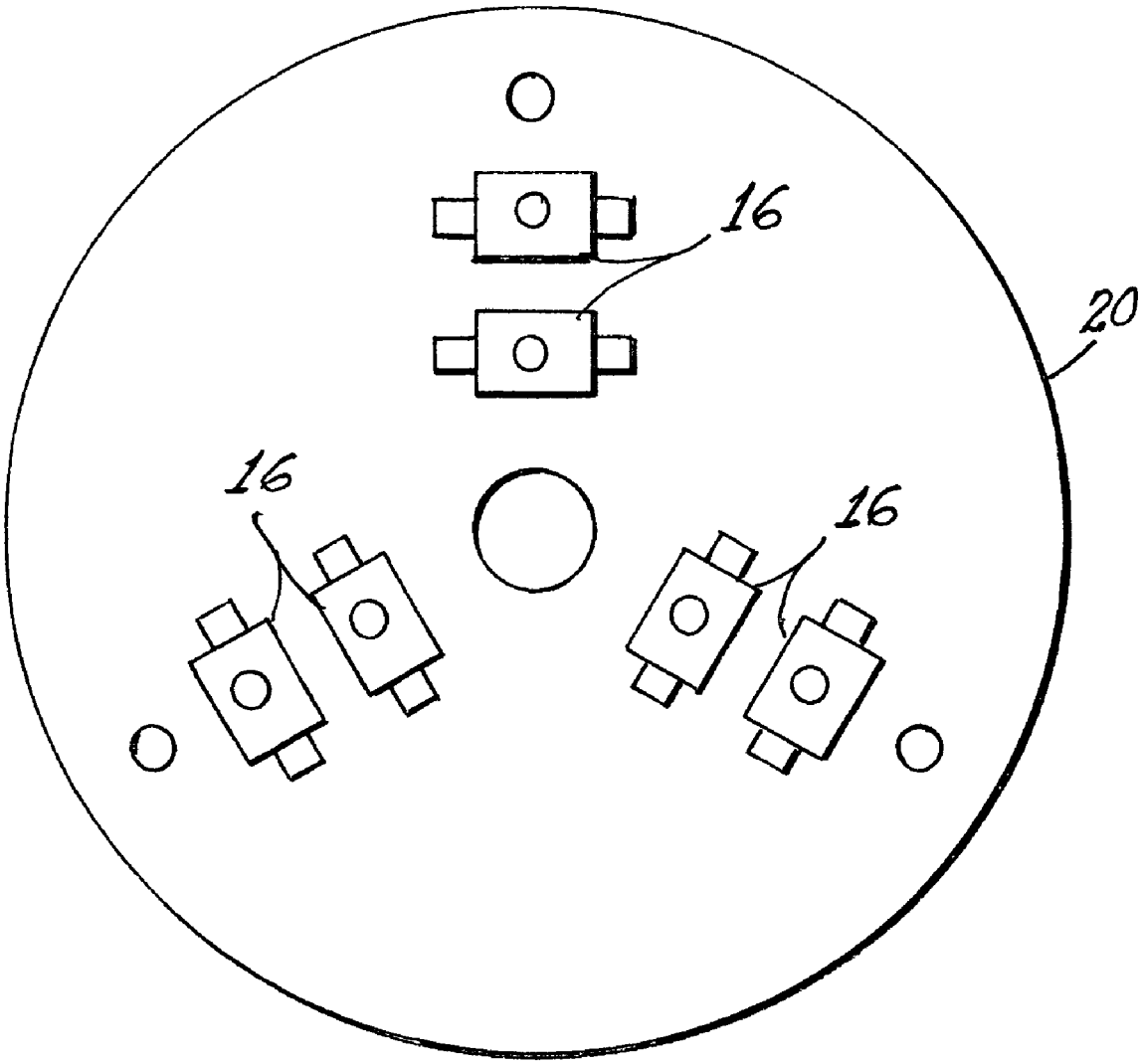
FIG. 5 is a plan view of a base for the lamp.
Figure 6:
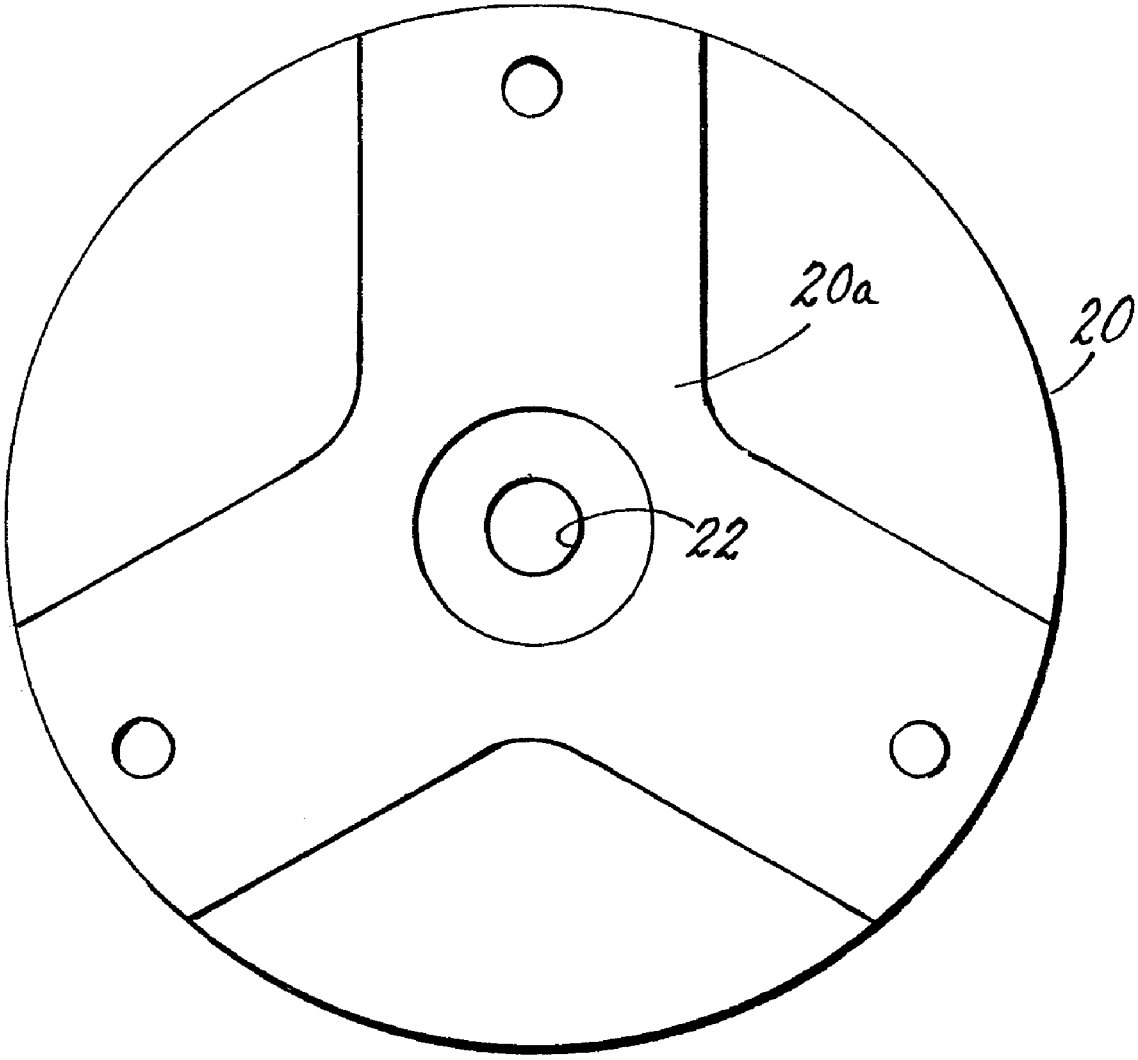
FIG. 6 is a plan view of the underside of a printed circuit board that can be used with the invention.

Referring now to the drawings with greater particularity, there is shown in FIG. 1 a multi-color light lamp 10 comprising a base 12 divided into a plurality of segments 14. In the embodiment shown there are three segments spaced 120 degrees apart. More or less segments can be employed if desired. At least one LED 16 is operatively positioned in each segment 14, the at least one LED 16 in each segment 14 emitting light in a color distinct from the light emitted by the at least one LED 16 in the other segments 14. Preferably, if the lamp is to be used for automotive purposes, the LEDs in a first segment can emit red light to be used as a taillight and a stop light, the LEDs in a second segment can emit yellow light to be used as a turn signal lamp, and the LEDs in the third segment can emit white light to function as a backup light. A light pipe 18 is operatively associated with the LEDs 16 in each segment for directing emitted light away from the base 12. The LEDs 16 (preferably two per segment) are mounted upon a thermally efficient printed circuit board 20 such as a flex-on aluminum board.

In one embodiment of the invention the base 12 includes a central mounting aperture 22 that can include a fastener 24, for example, a threaded bolt.

Alternatively, the center of the base 12 can be provided with an infrared emitter or sensor in the central aperture 22 and peripheral attachment apertures can be provided.

Ideally, the lamp 10 is mounted directly to a vehicle body. For example, a metal vehicle body 26 can be provided with a formed boss 30 to which the lamp 10 is attached via the fastener 24. In this instance, the vehicle body itself acts as a heat sink for removing excess heat from the operating LEDs 16.

While the light pipes 18 can be individually formed and attached relative to the LEDs, in a preferred embodiment the light pipes 18 are integrally formed with the base 12 as shown in the drawings. A suitable material for the light pipes and base is a molded plastic such as acrylic. Separators 18*a* between the respective segments 14 can be also be provided to aid in color separation.

To further insure good heat-sinking capability, the underside of the printed circuit board 20 can be provided with raised ribs 20*a* for engaging the metal vehicle body 26.

Likewise, spaces 12*a* can be provided in the base 12 intermediate the segments 14 to provide space for any necessary or desired electrical components while spaces 12*b* will accommodate the LEDs 16.

Since the red, amber and white light need to be visually separated the light pipes 18 accomplish this separation. The light pipes 18 receive, direct and shape the colored light input and guide it in directions that are visually distinct while preventing one color from bleeding into another.

While there have been shown and described what are present considered to be the preferred embodiments of the invention, it will be apparent to those skilled in the art that various changes and modifications can be made herein without departing from the scope of the invention as defined by the appended claims.

What is claimed is:

1. A multi-color light emitting lamp comprising:

a base divided into three segments and including a central mounting aperture having a fastener, said fastener being affixed to a vehicle body;

at least one LED operatively positioned in each segment, the at least one LED in each segment emitting light in a color distinct from the light emitted by the at least one LED in the other segments; said LEDs being mounted upon a thermally efficient printed circuit board; a first of said LEDs emitting red light, a second of said LEDs emitting yellow light and a third of said LEDs emitting white light; and a light pipe operatively associated with the at least one LED in each segment for directing emitted light away from said base.

2. The multi-color light emitting lamp of claim 1 wherein an optical plate is provided over said segments.

3. The multi-color light emitting lamp of claim 1 wherein said base includes a plurality of peripherally located mounting apertures.

4. The multi-color light emitting lamp of claim 3 wherein said base includes a center-mounted infra-red source.

* * * * *